US012140145B2

(12) United States Patent
Stoessel

(10) Patent No.: US 12,140,145 B2
(45) Date of Patent: Nov. 12, 2024

(54) GEAR PUMP

(71) Applicant: Valeo Powertrain GmbH, Ebern (DE)

(72) Inventor: Roland Stoessel, Ebern (DE)

(73) Assignee: Valeo Powertrain GmbH, Ebern (DE)

( * ) Notice: Subject to any disclaimer, the term of this patent is extended or adjusted under 35 U.S.C. 154(b) by 0 days.

(21) Appl. No.: 18/490,015

(22) Filed: Oct. 19, 2023

(65) Prior Publication Data

US 2024/0133377 A1 Apr. 25, 2024
US 2024/0229790 A9 Jul. 11, 2024

(30) Foreign Application Priority Data

Oct. 25, 2022 (DE) ..... 102022128264.3

(51) Int. Cl.
*F04C 2/18* (2006.01)
*F04C 15/00* (2006.01)

(52) U.S. Cl.
CPC ..... *F04C 2/18* (2013.01); *F04C 15/0061* (2013.01); *F04C 15/0088* (2013.01); *F04C 2230/20* (2013.01); *F04C 2240/30* (2013.01)

(58) Field of Classification Search
CPC ..... F04C 2/08; F04C 2/14; F04C 2/18; F04C 15/0061; F04C 15/0088; F04C 2230/20; F04C 2240/30; F04C 2240/50–56; F04C 2270/03
See application file for complete search history.

(56) References Cited

U.S. PATENT DOCUMENTS 6,123,533 A * 9/2000 McBurnett ..... F04C 2/084 418/191
2003/0059330 A1* 3/2003 Norman ..... F04C 2/126 418/206.1
2008/0107552 A1* 5/2008 Fujii ..... F04C 2/126 418/206.1
2011/0135498 A1* 6/2011 Gibson ..... F04B 35/00 475/223

(Continued)

FOREIGN PATENT DOCUMENTS

CH 716 640 A2 3/2021
CN 107923389 A 4/2018
DE 10 2017 106 827 A1 10/2018

(Continued)

OTHER PUBLICATIONS

German Search Report issued Jun. 26, 2023 in German Application 102022128264.3 filed on Oct. 25, 2022, 7 pages (with English Translation of Categories of Cited Documents & Written Opinion).

(Continued)

*Primary Examiner* — Theresa Trieu
(74) *Attorney, Agent, or Firm* — Oblon, McClelland, Maier & Neustadt, L.L.P.

(57) ABSTRACT

A gear pump having a pump housing, a rotatably mounted drive shaft extending into the pump housing, and a rotor of a drive motor. The rotor is attached in a rotationally fixed manner on the drive shaft, and at least one drive gearwheel which is arranged in a rotationally fixed manner on the drive shaft in the pump housing. At least one gearwheel is driven by the drive gearwheel, wherein the drive gearwheel is fixed axially on the drive shaft. The drive gearwheel together with the pump housing forms an axial bearing for the rotor.

6 Claims, 5 Drawing Sheets

(56) References Cited

U.S. PATENT DOCUMENTS

2022/0403843 A1* 12/2022 Stoessel ..... F04C 15/0057

FOREIGN PATENT DOCUMENTS

| | | | |
|---|---|---|---|
| DE | 10 2021 116 160 | A1 | 12/2022 |
| EP | 1 536 139 | B1 | 3/2006 |
| EP | 3 115 609 | B1 | 8/2018 |
| EP | 4 108 920 | A1 | 12/2022 |
| WO | WO 2022/111757 | A1 | 6/2022 |

OTHER PUBLICATIONS

European Search Report issued Mar. 4, 2024 in European Application No. 23205052.6, 10 pgs.

* cited by examiner

GEAR PUMP

BACKGROUND OF THE INVENTION

Field of the Invention

The invention relates to a gear pump having a pump housing, in particular to a multiple-flow gear pump.

Description of the Related Art

Gear pumps are used, for example, for dry sump lubrication of a powertrain in a motor vehicle. For example, a gear pump conveys lubricating oil out of a lubricating oil container to the lubrication sites of a drive machine of a gearbox.

A disadvantage of known gear pumps is that they are sometimes labour-intensive to assemble. In particular the mounting of the gearwheels of the pump and mounting of a rotor of the gear pumps is sometimes complex.

BRIEF SUMMARY OF THE INVENTION

It is therefore an object of the invention to specify a gear pump which can be assembled particularly simply.

According to the invention, this object is achieved by a gear pump having a pump housing, a rotatably mounted drive shaft extending into the pump housing, a rotor of a drive motor, said rotor being attached in a rotationally fixed manner on the drive shaft, at least one drive gearwheel which is arranged in a rotationally fixed manner on the drive shaft in the pump housing, and at least one gearwheel driven by the drive gearwheel, wherein the drive gearwheel is fixed axially on the drive shaft, and wherein the drive gearwheel together with the pump housing forms an axial bearing for the rotor.

The gear pump according to the invention has the advantage that an axial mounting of the rotor is achieved in a particularly simple manner without additional bearing elements. In particular, the drive gearwheel, which is present anyway, is used for axial mounting, which also contributes to a compact construction of the gear pump.

The axial mounting of the rotor by means of the drive gearwheel is achieved, for example, in that an axial movement of the drive gearwheel is limited, in particular by walls of the pump housing.

For example, the drive gearwheel bears axially against a wall of the pump housing by at least one end face.

The at least one drive gearwheel is for example pressed or injection-moulded onto the drive shaft or is fixed axially on the drive shaft by means of a stop element, in particular by means of a securing ring. In this way, the drive gearwheel can be axially positioned particularly precisely. The assembly of the gear pump is simplified further by injection-moulding the drive gearwheel onto the drive shaft, since fewer manual assembly steps are required.

According to one aspect, a second drive gearwheel is mounted on the drive shaft at a distance from the first drive gearwheel, wherein an intermediate element is present radially between the second drive gearwheel and the drive shaft, said intermediate element being in torque-transmitting engagement both with the drive shaft and with the second drive gearwheel, wherein the intermediate element is shorter than the second drive gearwheel as viewed in the axial direction.

Because a second drive gearwheel is mounted on the drive shaft, the gear pump has a two-layer design. This means that two axially adjacent drive gearwheels can be driven with the same drive shaft.

Because the intermediate element is shorter than the second drive gearwheel as viewed in the axial direction, positional tolerances can be compensated. In particular, the second drive gearwheel can be positioned flexibly a little in the axial direction without the intermediate element protruding beyond the second drive gearwheel.

The second drive gearwheel can be mounted on the intermediate element with play. A sliding guide is realized thereby between the second drive gearwheel and the intermediate element, as a result of which tolerance compensation is achieved particularly simply and in particular is produced automatically when the gear pump is assembled.

The axial movement of the second drive gearwheel can likewise be limited, in particular by walls of the pump housing.

The intermediate element is pressed or injection-moulded onto the drive shaft, for example. This likewise contributes to a simple assembly of the gear pump.

In each case, two driven gearwheels can be in engagement with each of the drive gearwheels. In this way, a four-flow gear pump is realized; that is, four separate fluid flows can be sucked in by the gear pump and conveyed to different sites in a powertrain. In particular, a four-flow gear pump is particularly suitable for cooling the total of four winding ends of two main motors of an electric vehicle.

The driven gearwheels preferably sit on a shaft with play. This means that the driven gearwheels run freely with the drive gearwheels.

According to a further embodiment, the gear pump is single-layered, wherein the drive gearwheel is in meshed engagement with two driven gearwheels, which in turn are in engagement with in each case one further driven gearwheel at a distance from the drive gearwheel.

In this context, "single-layered" means that all the gearwheels lie in one plane. With this construction, a design with a particularly low height and reduced length in comparison with a two-layer design can be achieved.

With the aforementioned arrangement of the gearwheels, a four-flow design is likewise achieved.

The driven gearwheels which are in engagement with the drive gearwheel each form a drive gearwheel for the further gearwheels.

In the single-layered design too, the driven gearwheels preferably each sit on a shaft with play.

For example, at least one oil intake duct is formed in the pump housing and extends from an oil intake opening in an underside of the pump housing to a gearwheel pair. When the pump housing is mounted on an oil sump, oil can be sucked out of the oil sump directly into the pump housing in this manner. In particular, the pump housing can be placed directly onto the oil sump.

In a multiple-flow design, in particular all the inlet openings are situated on the underside of the pump housing.

The pump housing is adjoined by a motor housing in which the drive motor for driving the drive shaft is arranged, wherein at least one fluid duct runs from the pump housing into the motor housing. In this way, oil can be conducted into the motor housing to cool the drive motor.

The drive motor is preferably an electric motor; that is, the drive motor comprises a rotor and a stator. The gear pump can be operated particularly efficiently thereby.

BRIEF DESCRIPTION OF THE SEVERAL VIEWS OF THE DRAWINGS

Further advantages and features can be found in the following description and the appended drawings. In the drawings:

FIG. 3 shows a cross section through the gear pump along line A-A in

FIG. 2,

FIG. 4 shows a cross section through the gear pump along line B-B in

FIG. 2,

DETAILED DESCRIPTION OF THE INVENTION

Figure 1:
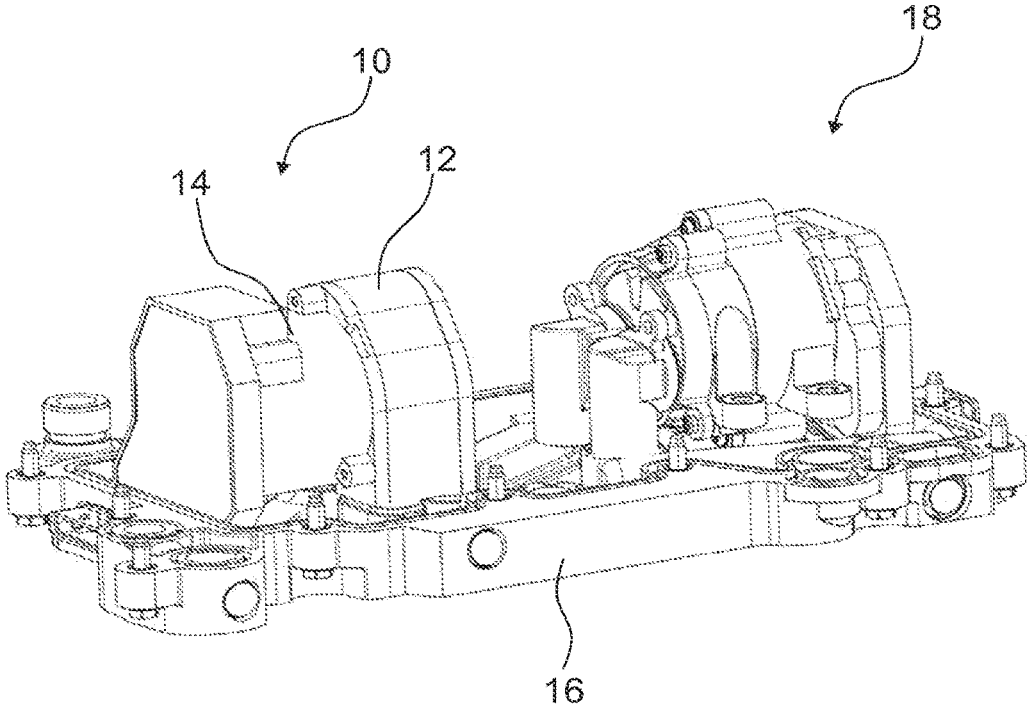
FIG. 1 shows a gear pump according to the invention in a first embodiment.

FIG. 1 shows a gear pump 10.

The gear pump 10 comprises a pump housing 12 and a motor housing 14.

In FIG. 1, the gear pump 10 is mounted on an oil sump 16.

FIG. 1 also shows a further pump 18, which is likewise mounted on the oil sump 16. However, the further pump 18 is not discussed in detail.

The pump housing 12, the motor housing 14 and the oil sump 16 are preferably manufactured from plastic.

Figure 2:
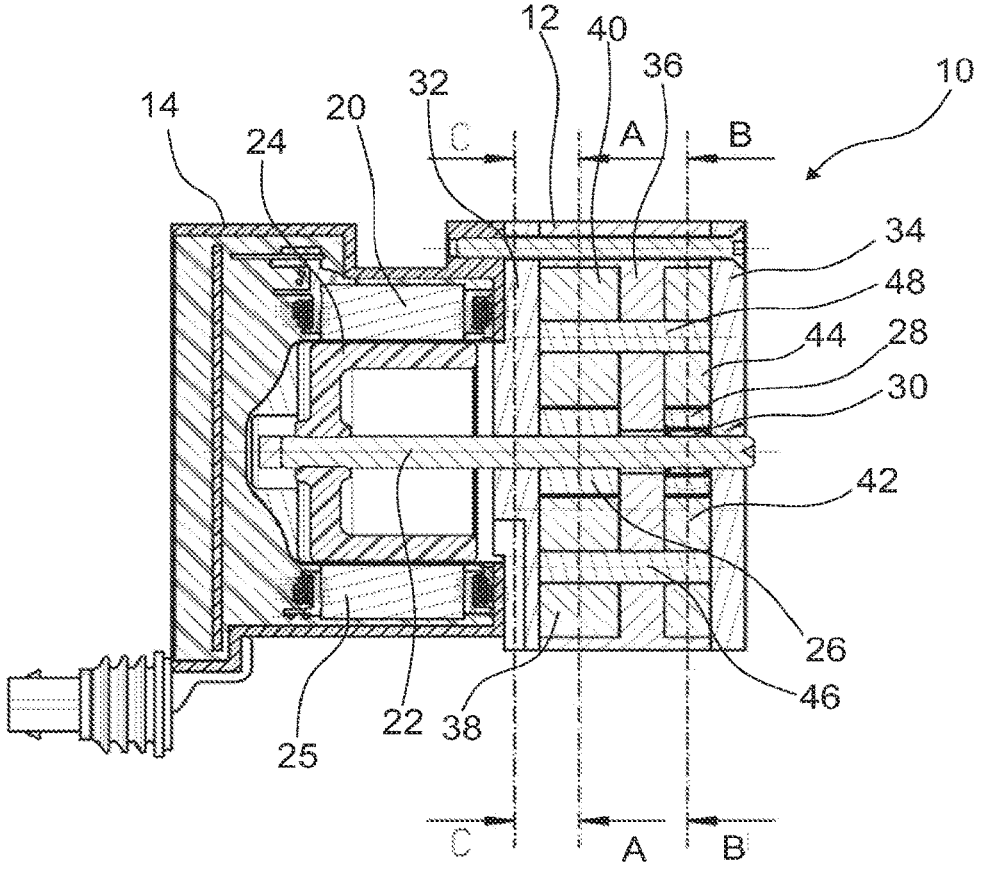
FIG. 2 shows a longitudinal section through the gear pump from FIG. 1.

Gearwheels of the gear pump 10 are accommodated in the pump housing 12, while a drive motor 20 is accommodated in the motor housing 14, as can be seen in FIG. 2.

The drive motor 20 is preferably potted in the motor housing 14.

The drive motor 20 drives a drive shaft 22, which extends into the pump housing 12.

The drive motor 20 is an electric motor and comprises a rotor 24, which is attached in a rotationally fixed manner on the drive shaft 22, and a stator 25.

A first drive gearwheel 26 and a second drive gearwheel 28 are arranged in a rotationally fixed manner on the drive shaft 22 inside the pump housing 12.

The two drive gearwheels 26, 28 are axially spaced from one another.

In the exemplary embodiment, the first drive gearwheel 26 is arranged directly on the drive shaft; that is, there is no intermediate element between the drive shaft 22 and the drive gearwheel 26.

For example, the first drive gearwheel 26 is pressed or injection-moulded onto the drive shaft 22.

Alternatively, the first drive gearwheel 26 can be axially fixed on the drive shaft 22 by means of a stop element, in particular by means of a securing ring.

An intermediate element 30 is arranged radially between the second drive gearwheel 28 and the drive shaft 22.

The intermediate element 30 is in torque-transmitting engagement both with the drive shaft 22 and with the second drive gearwheel 28.

The intermediate element 30 is shorter than the second drive gearwheel 28 as viewed in the axial direction, as a result of which flexible positioning of the second drive gearwheel 28 relative to the intermediate element 30 is possible.

The second drive gearwheel 28 is mounted on the intermediate element 30 with play, as a result of which a sliding guide is realized.

An axial movement of the first drive gearwheel 26 and of the second drive gearwheel 28 is limited, in particular by the fact that a wall of the pump housing 12 is arranged at both end faces of the drive gearwheels 26, 28. Specifically, the pump housing 12 has two end walls 32, 34 and an intermediate wall 36.

However, the drive gearwheels 26, 28 have a small axial play in the pump housing 12 to compensate manufacturing tolerances and thermal expansions.

Since the first drive gearwheel 26 is only axially displaceable together with the drive shaft 22, the first drive gearwheel 26 together with the pump housing 12 forms an axial bearing for the rotor 24.

The drive shaft 22 is also supported radially in the pump housing 12, in particular in both end walls 32, 34 of the pump housing 12.

Figure 3:
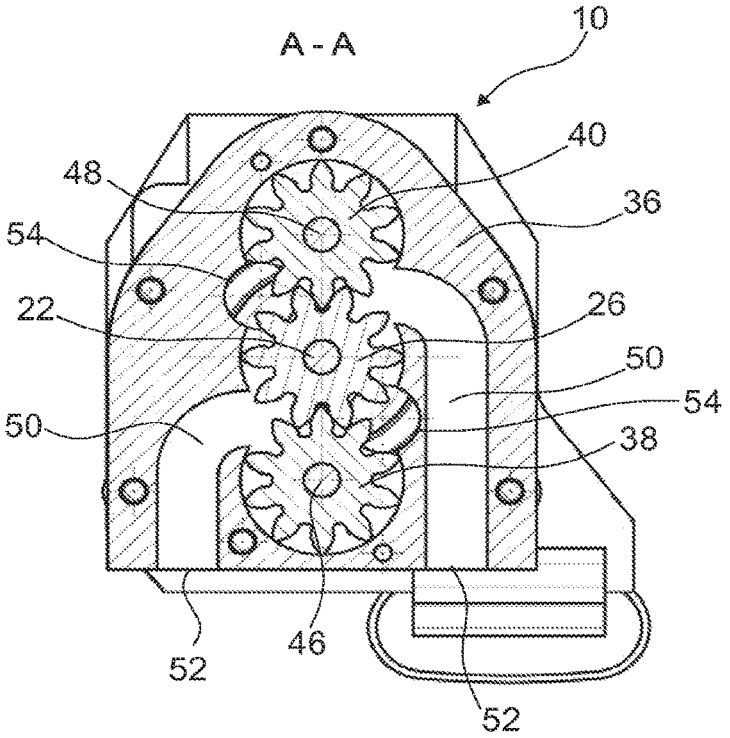
Figure 4:
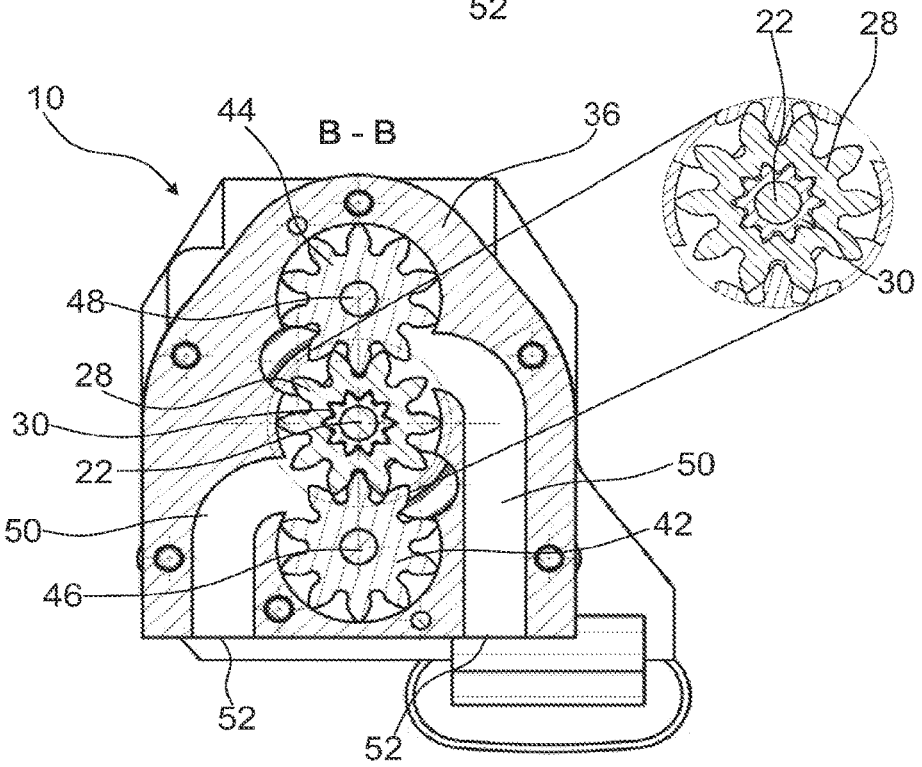

As can be seen both in FIG. 2 and in FIGS. 3 and 4, in each case two driven gearwheels 38, 40, 42, 44 are in engagement with each of the drive gearwheels 26, 28. The gear pump 10 is thus a four-flow gear pump.

Since the gearwheels 26, 28, 38, 40, 42, 44 are arranged in two layers, as can be seen in FIG. 2, such a structure is known as a two-layered design. A particularly narrow construction of the gear pump 10 can be realized by a two-layered design.

The driven gearwheels 38, 40, 42, 44 each sit on a shaft 46, 48 with play and run freely with the drive gearwheels 26, 28.

FIG. 4 shows the torque-transmitting connection between the second drive gearwheel 28 and the intermediate element 30 in detail.

In the exemplary embodiment, the intermediate element 30 is coupled in torque-transmitting fashion to the second drive gearwheel 28 by means of a spline connection.

The intermediate element 30 is pressed or injection-moulded on the drive shaft 22.

FIGS. 3 and 4 also show oil intake ducts 50, which each extend from an oil intake opening 52 in an underside of the pump housing 12 to a gearwheel pair.

The oil intake ducts 50 run in the pump housing 12 and are formed by corresponding cut-outs in the pump housing 12.

The oil intake ducts 50 run on both sides of the intermediate wall 36 in the pump housing 12. In the exemplary embodiment, the pump housing 12 overlaps with the gearwheels 26, 28, 38, 40, 42, 44 and has cut-outs in which the gearwheels 26, 28, 38, 40, 42, 44 are accommodated.

Figure 6:
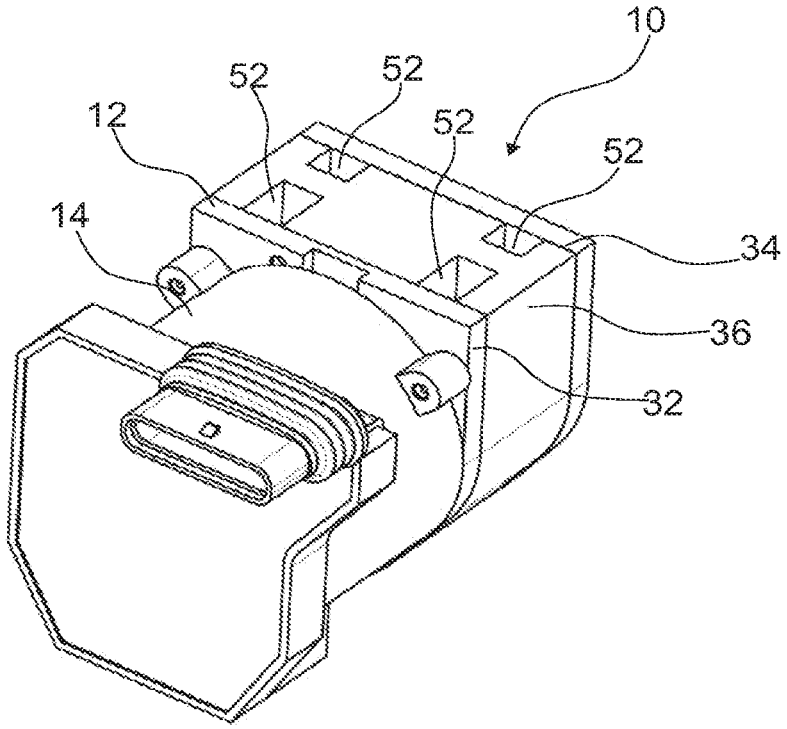
FIG. 6 shows the gear pump from FIG. 1 in a perspective view.
Figure 7:
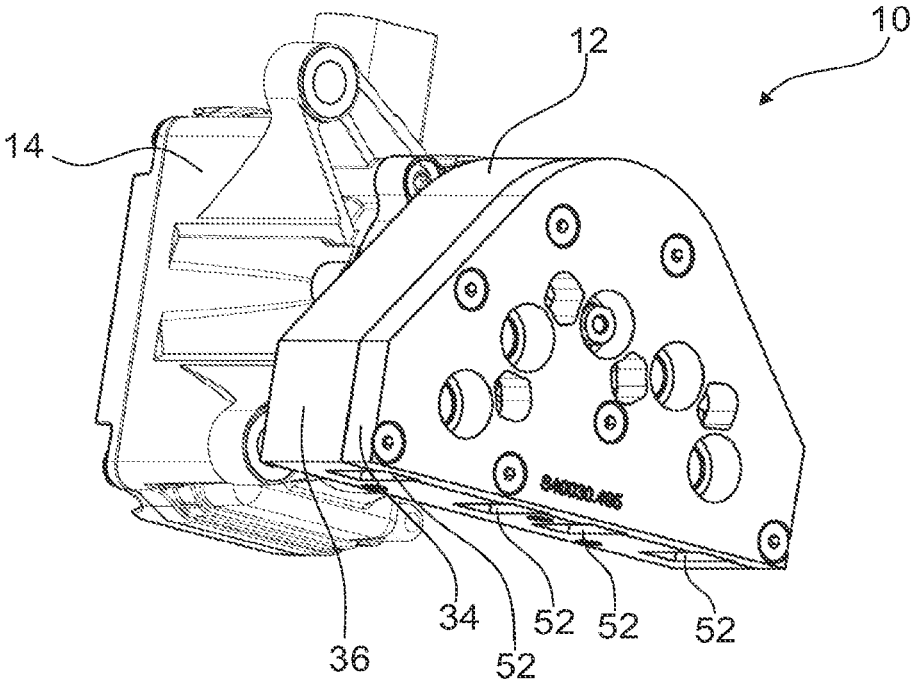
FIG. 7 shows a gear pump according to the invention in a further embodiment.

In the perspective view in FIG. 6, the oil intake openings 52 can be seen in the underside of the pump housing 12.

When the gear pump 10 is placed onto the oil sump 16, oil can be sucked in directly out of the oil sump 16.

Figure 5:
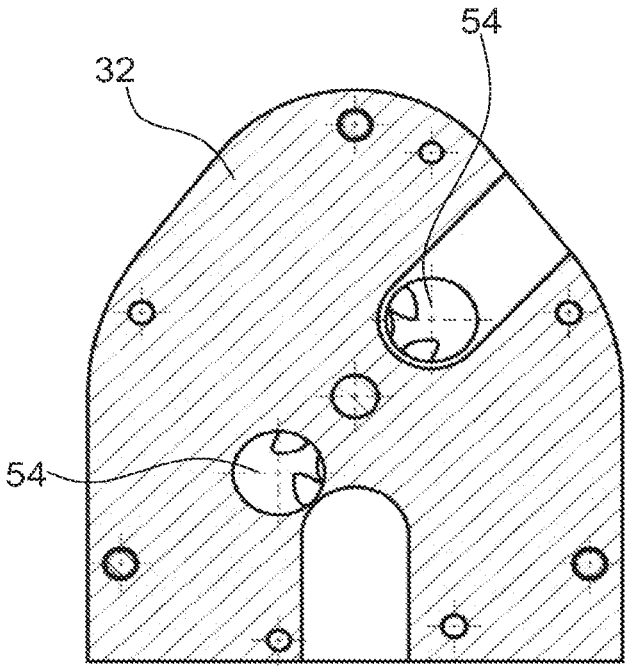
FIG. 5 shows a cross section through the gear pump along line C-C in FIG. 2.

FIG. 5 shows a section through the gear pump 10 running through the end wall 32 which separates the pump housing 12 from the motor housing 14.

In the end wall 32 there are fluid ducts 54, which are formed by cut-outs in the end wall 32 and run into the motor housing 14, as a result of which cooling of the drive motor 20 is realized.

FIGS. 7 to 10 show a gear pump 10 according to a further embodiment.

In the following, the same reference signs are used for identical structures with identical functions known from the above embodiment, and reference is made to the previous explanations in this respect; the differences between the respective embodiments are discussed below to avoid repetition.

A single-layered design is realized in the gear pump 10 of FIGS. 7 to 10, which means that all the gearwheels 26, 38, 40, 42, 44 lie in one plane.

As a result, the construction of the gear pump 10 is particularly flat.

In addition, only five gearwheels in total are needed for a four-flow design, while six gearwheels are needed to realize a four-flow design in the embodiment shown in FIGS. 1 to 6.

Figure 9:
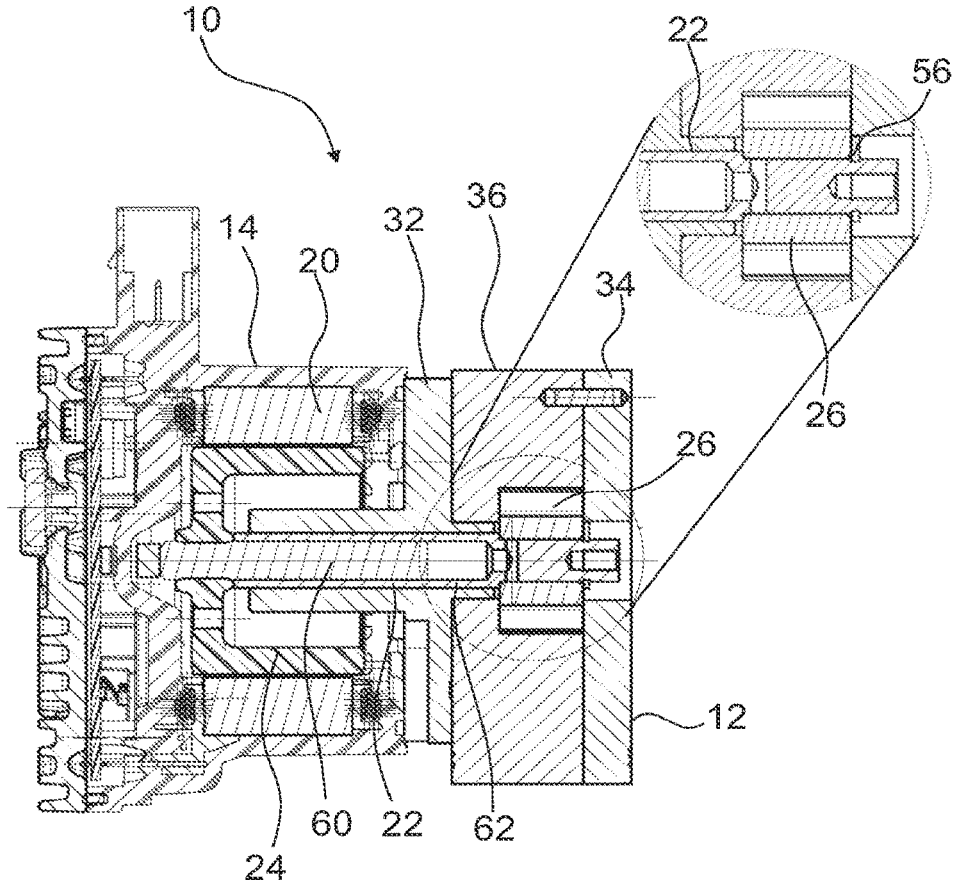
FIG. 9 shows a longitudinal section through the gear pump from FIG. 7.
Figure 10:
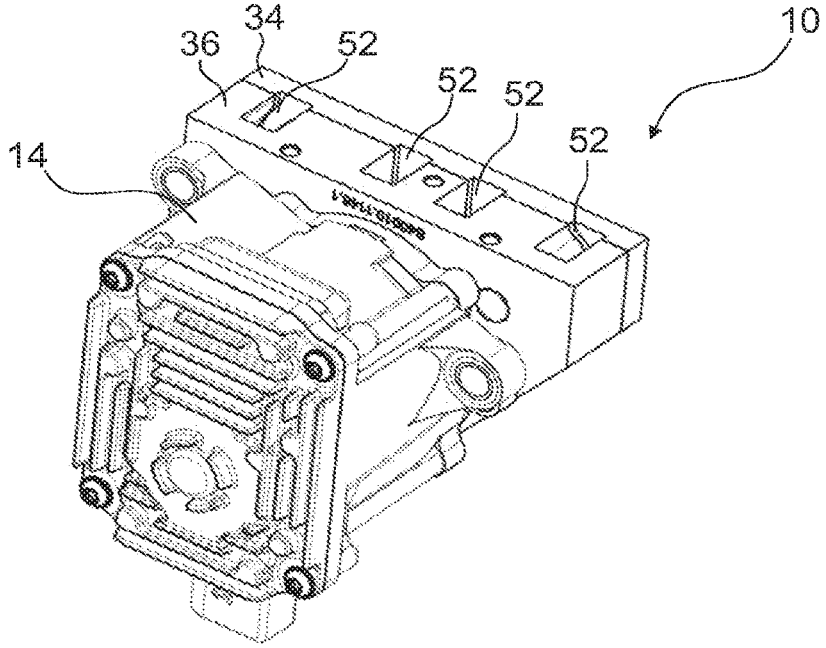
FIG. 10 shows a perspective view of the gear pump from FIG. 7.

The drive gearwheel 26 is likewise fixed axially on the drive shaft 22, wherein this is realized by a stepped portion in the drive shaft 22 in combination with a securing ring 56 (see FIG. 9).

Figure 8:
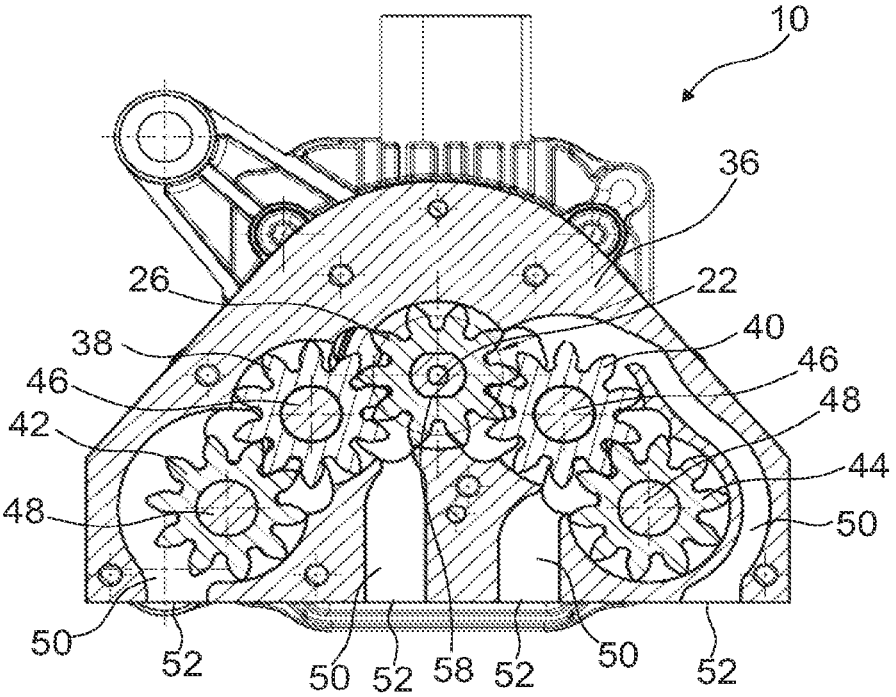
FIG. 8 shows a cross section through the gear pump from FIG. 7.

The rotationally fixed coupling between the drive shaft 22 and the drive gearwheel 26 is achieved by flattened portions 58 on the drive shaft 22, as can be seen in FIG. 8.

However, it is also conceivable for the drive gearwheel 26 to be pressed or injection-moulded onto the drive shaft 22, as in the previous embodiment.

The drive gearwheel 26 is in meshed engagement with two driven gearwheels 38, 40, which in turn are each in engagement with one further driven gearwheel 42, 44 at a distance from the drive gearwheel 26.

The driven gearwheels 38, 40 which are in engagement with the drive gearwheel 26 thus each form a drive gearwheel for the further gearwheels 42, 44.

In the embodiment according to FIGS. 7 to 10, the drive shaft 22 is in two parts, wherein the two parts 60, 62 of the drive shaft 22 are inserted into one another telescopically. As a result, the part 60 of the drive shaft 22 to be overmoulded with the rotor 24 can be kept simple, while the part 62 of the drive shaft 22 with the flattened portions 58 is produced as an extruded part, for example. The part 62 is pressed onto the overmoulded part 60, for example.

The invention claimed is:

1. A gear pump comprising:

a pump housing, a rotatably mounted drive shaft extending into the pump housing, a rotor of a drive motor, said rotor being attached in a rotationally fixed manner on the drive shaft, and a drive gearwheel which is arranged in a rotationally fixed manner on the drive shaft in the pump housing, wherein the drive gearwheel is fixed axially on the drive shaft, wherein the drive gearwheel together with the pump housing forms an axial bearing for the rotor, wherein the gear pump is single-layered, wherein the drive gearwheel is in meshed engagement with two driven gearwheels, each of the two driven gearwheels in turn are in engagement with one further driven gearwheels at a distance from the drive gearwheel, in respectively, such that a four-flow design is achieved, and wherein at least one oil intake duct is formed in the pump housing and extends from an oil intake opening in an underside of the pump housing to each of gearwheel pairs of the gear pump lying in one plane.

2. The gear pump according to claim 1, wherein the drive gearwheel is pressed or injection-moulded onto the drive shaft or is fixed axially on the drive shaft by a securing ring.

3. The gear pump according to claim 2, wherein the drive motor is an electric motor.

4. The gear pump according to claim 1, wherein the pump housing is adjoined by a motor housing in which the drive motor for driving the drive shaft is arranged, wherein at least one fluid duct runs from the pump housing into the motor housing.

5. The gear pump according to claim 1, wherein the drive motor is an electric motor.

6. The gear pump according to claim 1, wherein the drive shaft includes two parts which are inserted into one another telescopically.

* * * * *